United States Patent [19]

Kemper

[11] Patent Number: 4,480,789

[45] Date of Patent: Nov. 6, 1984

[54] WATER NOZZLE

[75] Inventor: Franz Kemper, Essen, Fed. Rep. of Germany

[73] Assignee: Bergwerksverband GmbH, Essen, Fed. Rep. of Germany

[21] Appl. No.: 506,585

[22] Filed: Jun. 22, 1983

Related U.S. Application Data

[63] Continuation of Ser. No. 264,669, May 15, 1981, abandoned.

[30] Foreign Application Priority Data

May 20, 1980 [DE] Fed. Rep. of Germany ... 8013540[U]

[51] Int. Cl.[3] ..... B05H 15/02

[52] U.S. Cl. ..... 239/116; 239/123; 239/571

[58] Field of Search ..... 239/114, 116, 123, 487, 239/570, 571

[56] References Cited

U.S. PATENT DOCUMENTS

| | | | |
|---|---|---|---|
| 2,806,740 | 9/1957 | Fredrickson et al. | 239/571 X |
| 3,752,400 | 8/1973 | Calder | 239/116 |
| 4,204,557 | 8/1973 | Scragg | 239/123 X |
| 4,223,838 | 10/1980 | Maria-Vittorio-Torrisi | 239/123 X |

*Primary Examiner*—John J. Love
*Assistant Examiner*—Mary F. McCarthy
*Attorney, Agent, or Firm*—Michael J. Striker

[57] ABSTRACT

A water nozzle, particularly for dust suppressing for example at cutting rollers, has a housing with a central opening, a guiding sleeve received at least partially in the central opening of the housing and having an inner passage which is stepped in an axial direction, and a piston stepped in the axial direction and displaceable in the passage of the guiding sleeve to a position in which a narrow gap is formed between the piston and the guiding sleeve so as to prevent solid particles entrained in a flow of water from entering the nozzle. The piston is spring biased in a direction opposite to the direction of the flow of water, so that upon termination of the latter the piston dislodges the solid particles accumulated at the nozzle.

10 Claims, 1 Drawing Figure

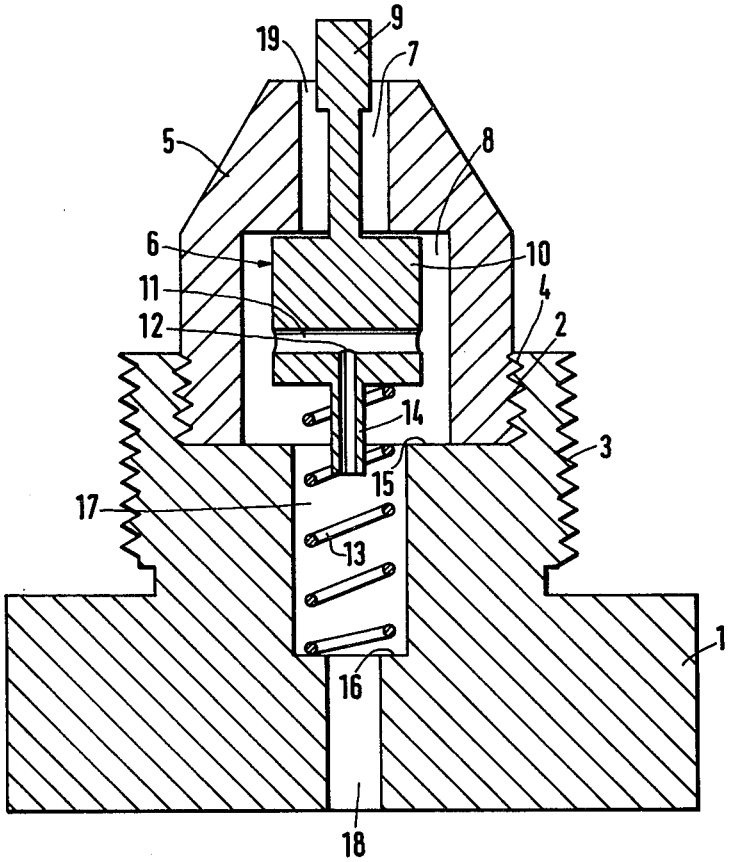
9
19
7
5
8
6
10
11
4
12
2
14
3
15
17
13
1
16
18

WATER NOZZLE

This application is a continuation of application Ser. No. 264,669 filed May 15, 1981, now abandoned.

BACKGROUND OF THE INVENTION

The present invention relates to a water nozzle, and particularly to a water nozzle for dust spraying, for example at cutting rollers.

Water nozzles of the above mentioned general type are known in the art. A known water nozzle has a housing which is screwed in a water supply conduit and is provided at its water inlet side with an intercepting opening and at its water outlet side with a central opening of a smaller diameter. The known nozzles possess the disadvantage that they are always clogged by solid particles entrained in the supply water, for example by rust particles of the supply water conduit. Cleaning of such nozzles for removal of the solid particles is performed by screwing off of the water nozzles and spraying them through. This process involves stoppage of the cutting rollers and is thereby connected with high costs and labor expenditures.

Another water nozzle has been proposed in which the process of elimination of clogging is improved and carrying out of the cleaning is facilitated. In this water nozzle an insert is arranged in the intercepting opening and a spraying chamber is formed between the central opening and the insert. The spraying chamber provides for an additional whirling of the water, and thereby depositing of the dirt in the region of the nozzle is eliminated. Moreover, the spraying chamber also provides for facilitating of the cleaning inasmuch as the cleaning work can be performed with the aid of a thin wire inserted through the central opening. However, it has been recognized that this water nozzle is not designed so as to prevent dirtying of parts of the spraying chamber, and this dirt is pushed back during the cleaning process into the opening of the insert.

SUMMARY OF THE INVENTION

Accordingly, it is an object of the present invention to provide a water nozzle, particularly for dust suppression, for example for cutting roller or other arrangements, which avoids the disadvantages of the prior art.

More particularly, it is an object of the present invention to provide a water nozzle in which clogging of the same is eliminated and reliable operation of the nozzle is guaranteed, and which at the same time is simple to manufacture and cost economical.

In keeping with these objects, and with others which will become apparent hereinafter, one feature of the present invention resides, briefly stated, in a water nozzle which has a housing with a central opening, a guiding sleeve received at least partially in the central opening of the housing and having an inner passage which is stepped in an axial direction, and a piston which is also stepped in the axial direction and is axially displaceable in the passage of the guiding sleeve to a position in which a narrow gap is formed between the piston and the guiding sleeve so as to prevent solid particles entrained in a flow of water from entering the nozzle.

The guiding sleeve may be received in a first portion of the opening of the housing, the first portion located in the region of an inlet end and having a greater diameter. The piston is prestressed in the axial direction by a spring.

In accordance with another advantageous feature of the present invention, the passage of the guiding sleeve has a narrower section in the region of the inlet end and a wider section in the region of the outlet end, and the piston has an insignificantly wider part arranged in the region of the narrower section and a significantly wider part arranged in the region of the wider section of the passage of the guiding sleeve.

In accordance with still another especially advantageous feature of the present invention, the second significantly wider part of the piston is provided with additional openings.

The technical advantages of the invention reside in the fact that the high costs of the stoppages of the equipment which are increased because of the continuously required cleaning of the water nozzles, are considerably reduced because the water nozzle in accordance with the present invention is actually equipped with a self-operating cleaning arrangement.

The novel features which are considered characteristic for the present invention are set forth in particular in the appended claims. The invention itself, however, both as to its construction and its method of operation, together with additional objects and advantages thereof, will be best understood from the following description of preferred embodiments, when read in connection with the accompanying drawing.

BRIEF DESCRIPTION OF THE DRAWING

The single FIGURE of the drawing is a view showing a section of the water nozzle in accordance with the present invention.

DESCRIPTION OF A PREFERRED EMBODIMENT

A water nozzle in accordance with the invention has a housing which is identified by reference numeral 1. The housing 1 has an outer thread 3 and is provided with a central intercepting opening.

The central opening of the housing 1 is subdivided into two portions identified by reference numerals 2 and 17 and having different diameters. The portion 2 of the central opening has a diameter which is greater than the diameter of the portion 17 thereof.

The water nozzle is further provided with a guiding sleeve 5. The guiding sleeve 5 is arranged in the portion 2 of the central opening of the housing 1. The guiding sleeve 5 is connected with the housing 1 by a thread which is identified by reference numeral 4. The above mentioned thread 3 of the housing 1 serves for connection of the nozzle with a water supply conduit.

The guiding sleeve 5 has a central passage. The central passage of the guiding sleeve 5 has a narrower guiding section 7 provided at its water inlet side and a wider section 8 provided at its water outlet side and immediately adjoining the section 7. The wider section 8 of the passage of the guiding sleeve 5 extends inwardly of the housing and merges into the portion 17 of the central opening of the housing 1. The portion 17 of the central opening of the housing 1 forms together with the section 8 of the central passage of the sleeve 5 a shoulder 15.

A piston 6 which has several steps spaced from one another in an axial direction is arranged inside the guiding sleeve 5. The piston 6 has at the water inlet side an insignificantly wider part 9 and at the opposite side a significantly wider part 10. The part 10 is arranged in the region of the section 8 of the guiding sleeve 5. At the water outlet end, the piston 6 is provided with a piston stud 14. The piston 6 is prestressed by a spiral spring 13.

The spring 13 is located inside the portion 17 of the central opening of the housing 1. A shoulder 16 is formed in the portion 17 and forms an abutment for the spring 13. The upper end of the spring is guided by the above mentioned piston stud 14. Finally, the central opening of the housing 1 has an outlet portion 18 which is connected with the portion 17.

The water nozzle in accordance with the present invention operates in the following manner. When water enters the nozzle, the piston 6 disgraces from its seat inside the guiding sleeve 5 and is pressed in the axial direction against the action of the prestressed spring 13. The part 9 of the piston 6 forms together with the section 7 of the passage of the guiding sleeve 5 a narrow annular gap 19. When the flow of water is terminated, the solid particles which do not enter the annular gap 19 and cannot pass the central opening 18, are dislodged by the spring-biased piston 6 from the inlet opening and displaces into the inner space of a not shown water supply conduit surrounding the guide sleeve 5. In order to provide an additional whirling action inside the portion 17 of the opening of the housing 1 and prevent settling of the solid particles in the same, the spring 13 has a smaller cross section than the portion 17.

It will be understood that each of the elements described above, or two or more together, may also find a useful application in other types of constructions differing from the types described above.

While the invention has been illustrated and described as embodied in a water nozzle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that from the standpoint of prior art fairly constitute essential characteristics of the generic or specific aspects of this invention.

What is claimed as new and desired to be protected by Letters Patent is set forth in the appended claims:

1. A water nozzle connectable with a water supply conduit, particularly for dust suppressing for example at cutting rollers, comprising a housing having a central opening with an axis;

a guiding sleeve received at least partially in said central opening of said housing and having an inner passage which is stepped in an axial direction;

a piston stepped in the axial direction and having an enlarged piston portion displaceable in said passage of said guiding sleeve in a first axial direction under the action of flow of water; and a spring urging said piston in a second axial direction which is opposite to said first axial direction, said piston and said guiding sleeve being formed so that when said piston is displaced by the flow of water in said first axial direction, a single narrow gap with smooth walls and of a constant cross section in the axial direction is formed between said enlarged piston portion of said piston and said guiding sleeve, so that the water can flow through said gap but solid particles entrained in water and exceeding said gap cannot pass therethrough and therefore interrupt the flow of water, whereby when said spring displaces said piston in said second axial direction said enlarged piston portion of said piston displaces in said gap without being completely withdrawn therefrom and dislodges the solid particles from said gap intact, because said gap is single and has smooth walls and constant cross section, so as to displace the solid particles toward a water supply conduit.

2. A water nozzle as defined in claim 1, wherein said opening of said housing has inlet and outlet sides and is formed with a first portion of a greater diameter at said inlet side and a second portion of a smaller diameter at said outlet side, said guiding sleeve being received in said first portion of said opening of said housing.

3. A water nozzle as defined in claim 1, wherein said housing has means for connecting the same with the water supply conduit, said connecting means being formed as a thread provided on said housing.

4. A water nozzle as defined in claim 1, wherein said passage of said guiding sleeve has inlet and outlet sides and is formed with a narrower section at said inlet side and a wider section at said outlet side, said piston having a first part which is insignificantly wider than a remaining part of said piston and is located in the region of said narrower section of said passage of said guiding sleeve, and a second part which is significantly wider than the remaining part thereof and is located in the region of said wider section of said passage of said guiding sleeve.

5. A water nozzle as defined in claim 4, wherein said second significantly wider part of said piston is provided with additional through going passages for the flow of water.

6. A water nozzle as defined in claim 5, wherein said additional through going passages of said piston are open into said opening of said housing and said passage of said guiding sleeve.

7. A water nozzle as defined in claim 4, wherein said piston has a stud adjoining said second significantly wider part thereof, said spring being supported on said stud of said piston.

8. A water nozzle as defined in claim 2, wherein said second portion of said opening of said housing has a step forming an abutment for said spring.

9. A water nozzle as defined in claim 1, wherein said second portion of said opening of said housing has a predetermined diameter, said spring having a diameter which is smaller than the diameter of said second portion of said opening of said housing.

10. A water nozzle connectable with a water supply conduit, particularly for dust suppressing for example at cutting rollers, comprising a housing having a central opening with an axis;

a guiding sleeve received at least partially in said central opening of said housing and having an inner passage which is stepped in an axial direction;

a piston stepped in the axial direction and having an enlarged piston portion displaceable in said passage of said guiding sleeve in a first axial direction under the action of flow of water; and a spring urging said piston in a second axial direction which is opposite to said first axial direction, said piston and said guiding sleeve being formed so that when said piston is displaced by the flow of water in said first axial direction, a single narrow gap with smooth walls and of a constant cross section in the axial direction is formed between said enlarged piston portion of said piston and said guiding sleeve, so that the water can flow through said gap but solid particles entrained in water and exceeding said gap cannot pass therethrough and therefore interrupt the flow of water, whereby when said spring displaces said piston in said second axial direction said enlarged piston portion of said piston displaces in said gap without being completely withdrawn therefrom and dislodges the solid particles from said gap intact, because said gap is single and has smooth walls and constant cross section, so as to displace the solid particles toward a water supply conduit without comminuting or abrading them.

* * * * *